US006989180B2

(12) United States Patent
Keeton et al.

(10) Patent No.: US 6,989,180 B2
(45) Date of Patent: Jan. 24, 2006

(54) THERMAL TRANSFER RIBBON WITH END OF RIBBON MARKERS

(75) Inventors: Mark E. Keeton, Kettering, OH (US); Thomas J. Obringer, Vandalia, OH (US); Richard D. Puckett, Miamisburg, OH (US); Jeffery S. Denton, Springboro, OH (US)

(73) Assignee: NCR Corporation, Dayton, OH (US)

( * ) Notice: Subject to any disclaimer, the term of this patent is extended or adjusted under 35 U.S.C. 154(b) by 145 days.

(21) Appl. No.: 10/682,653

(22) Filed: Oct. 9, 2003

(65) Prior Publication Data

US 2005/0079298 A1 Apr. 14, 2005

(51) Int. Cl.
*B41M 5/40* (2006.01)

(52) U.S. Cl. ..... 428/32.6; 428/32.87

(58) Field of Classification Search ..... 428/32.6, 428/32.87

See application file for complete search history.

(56) References Cited

U.S. PATENT DOCUMENTS

| | | | | |
|---|---|---|---|---|
| 2,174,351 | A | 9/1939 | Neidich | |
| 3,663,278 | A | 5/1972 | Blose et al. | |
| 4,115,013 | A | 9/1978 | Hedstrom | |
| 4,146,338 | A | 3/1979 | Hedstrom | |
| 4,315,643 | A | 2/1982 | Tokumaga et al. | |
| 4,401,394 | A | 8/1983 | Hume et al. | |
| 4,428,695 | A | 1/1984 | Jamieson | |
| 4,494,886 | A | 1/1985 | Kondo et al. | |
| 4,628,000 | A | 12/1986 | Talvalkar et al. | |
| 4,655,624 | A | 4/1987 | Kondo et al. | |
| 4,880,325 | A | 11/1989 | Ueda et al. | |
| 4,923,749 | A | 5/1990 | Talvalkar et al. | |
| 4,970,531 | A | 11/1990 | Shimizu et al. | |
| 4,985,292 | A | 1/1991 | Umise et al. | |
| 4,988,563 | A | 1/1991 | Wehr | |
| 5,087,137 | A | 2/1992 | Burnard et al. | |
| 5,110,229 | A | 5/1992 | Ide | |
| 5,128,308 | A | 7/1992 | Talvalkar et al. | |
| 5,150,977 | A | 9/1992 | Yoshikawa | |
| 5,240,781 | A | 8/1993 | Obatta et al. | |
| 5,248,652 | A | 9/1993 | Talvalkar et al. | |
| 5,445,463 | A | 8/1995 | Paranjpe | |
| 5,721,058 | A | 2/1998 | Fujimaki | |
| 5,803,627 | A | 9/1998 | Paranjpe | |
| 5,957,596 | A | 9/1999 | Hastings et al. | |
| 5,967,679 | A | 10/1999 | Beadman et al. | |
| 6,166,755 | A * | 12/2000 | Obringer et al. | 347/217 |
| 6,174,400 | B1 | 1/2001 | Krutak et al. | |
| 6,201,255 | B1 | 3/2001 | Torchalski et al. | |
| 6,428,222 | B1 | 8/2002 | Dunham | |

* cited by examiner

*Primary Examiner*—B. Shewareged
(74) *Attorney, Agent, or Firm*—Millen White Zalano & Branigan, P.C.

(57) ABSTRACT

Thermal transfer ribbons which employ a reflective sensor marker of a small size for detecting the end of the ribbon and also thermal transfer ribbons which employ a reflective sensor marker and a transparent sensor marker for detecting the end of the ribbon.

15 Claims, 1 Drawing Sheet

THERMAL TRANSFER RIBBON WITH END OF RIBBON MARKERS

FIELD OF THE INVENTION

The present invention relates to thermal transfer printing wherein images are formed on a receiving substrate (paper) by heating extremely precise areas of a print ribbon with thin film resistors. Heating of the localized areas causes transfer of ink from the ribbon to a receiving substrate.

More particularly, the present invention is directed to thermal transfer ribbons having "end of ribbon" markers.

BACKGROUND OF THE INVENTION

Thermal transfer printing has displaced impact printing in many applications due to advantages such as relatively low noise levels during the printing operation. Thermal transfer printing is widely used in special applications such as in the printing of machine-readable bar codes and magnetic alphanumeric characters. The thermal transfer process provides great flexibility in generating images and allows for broad variations in style, size and color of the printed image. Representative documentation in the area of thermal printing includes the following patents:

U.S. Pat. No. 3,663,278, issued to J. H. Blose, et al. on May 16, 1972;

U.S. Pat. No. 4,315,643, issued to Y. Tokunaga, et al. on Feb. 16, 1982;

U.S. Pat. Nos. 4,628,000, 4,923,749, 5,128,308 and 5,248,652, issued to S. G. Talvalkar, et al.

U.S. Pat. No. 4,983,446, issued to Taniguchi, et al. on Jan. 8, 1991;

U.S. Pat. No. 4,988,563, issued to Wehr on Jan. 29,1991; and

U.S. Pat. No. 5,240,781, issued to Obatta, et al.

Most thermal transfer ribbons employ a synthetic resin as a substrate. Polyethylene terephthalate (PET) polyester is commonly used. The functional layer which transfers ink, also referred to as the thermal transfer layer, is positioned on one side of the substrate and a protective silicone back coat is typically positioned on the other side of the polyethylene terephthalate substrate to simplify passage under a thermal print head.

Many thermal transfer printer manufacturers specify that a silver reflective trailer must be attached to the end of the ribbon that trips a sensor to stop the printer for a ribbon change. Other manufacturers require a clear trailer wherein light is transmitted through the ribbon tripping a sensor and stopping the printer. A conventional reflective trailer is shown in FIG. 1, which is typically 20 inches in length. U.S. Pat. No. 4,985,292 describes alternative embodiments wherein end marks are printed on a portion of a thermal transfer ribbon either as a long continuous strip or in segments. U.S. Pat. No. 5,721,058 discloses methods of making sensor marks on a thermal transfer ribbon using thermally meltable ink.

Short length reflective segments have been used as markers in ribbons for impact printing such as typewriter ribbons. For example, U.S. Pat. No. 2,174,351 discloses the use of a band of aluminum paint applied to a typewriter ribbon to catch the eye of the operator and signal the end of the ribbon. U.S. Pat. Nos. 4,655,624 and 5,110,229 disclose the use of reflective aluminum sheets for use with photosensors to detect the end of a ribbon such as a typewriter ribbon. End of ribbon sensors for typewriter ribbons are also disclosed in U.S. Pat. Nos. 4,115,013, 4,146,388, 4,428,695 and 5,150, 977. U.S. Pat. No. 4,401,394 discloses a universal end of ribbon sensing system for impact printing with ribbons having a reflecting tape segment and a clear transparent tape segment near its end.

Conventional thermal transfer ribbons may have a trailer positioned on an end thereof which is attached to the spool. The trailer has simple functions and there are many materials which will meet the physical property requirements necessary for the trailer to perform these simple functions. The materials used for the trailers of the thermal transfer ribbons may be identical to the substrate of the thermal transfer ribbon and so they can be synthetic resins such as polyethylene terephthalate (PET) polyester films. They can also be of a thickness greater than the polyester ribbon substrate (about 1 to 1.5 mil) so as to provide greater stiffness or they can be of a different material such as paper. These trailers can be adhered to one end of the polyester substrate with conventional pressure sensitive adhesive tape. The other end of these trailers is typically attached to the spool upon which the thermal transfer ribbon is stored with conventional pressure sensitive adhesive tape.

SUMMARY OF THE INVENTION

The present invention provides thermal transfer ribbons with a small reflective sensor marker positioned on an end of the thermal transfer ribbon. The reflective sensor marker permits the detection of the end of the thermal transfer ribbon by a sensor within a thermal transfer printer. The sensor stops the thermal transfer printer from printing once a predetermined amount of light reflected from the thermal transfer ribbon is detected, allowing the ribbon to be replaced. The small reflective sensor marker comprises a single light reflecting surface having a dimension along the length of the ribbon of at least 0.5 inches and less than ten inches, preferably less than 5 inches, more preferably less than 2 inches, and most preferably from about 1 inch to about 2 inches.

The present invention also provides dual use thermal transfer ribbons with two "end of ribbon" markers. These thermal transfer ribbons have both a reflective sensor marker and a transparent sensor marker which permit the detection of the end of said thermal transfer ribbon by two different types of sensors. These different sensors are typically within different types of thermal transfer printers. Detection of a predetermined amount of reflected or transmitted light from the thermal transfer ribbon by the appropriate sensor will stop the thermal transfer printer from printing and allow the ribbon to be changed.

It has been discovered that a small reflective surface such as a reflective tape of a small size can replace a long reflective trailer and still activate sensors contained within conventional thermal transfer printers. This small reflective tape can be used with transparent sensor markers to allow use of the thermal transfer ribbon in different types of thermal transfer printers.

BRIEF DESCRIPTION OF THE DRAWINGS

FIG. 1 illustrates a conventional thermal transfer ribbon 5 that is spent. The functional portion 100 has been wound around a spool 11 during use. Reflective trailer 1 is positioned on the end of the ribbon attached to functional portion 100.

FIG. 2 illustrates a thermal transfer ribbon of this invention 15 which is also spent. Functional portion 100 has been wound on spool 11 during use. Transparent trailer 3 is positioned at the end of the ribbon attached to functional portion 100, and reflective sensor mark 2 is a reflective ink printed over transparent trailer 3.

Figure 1:
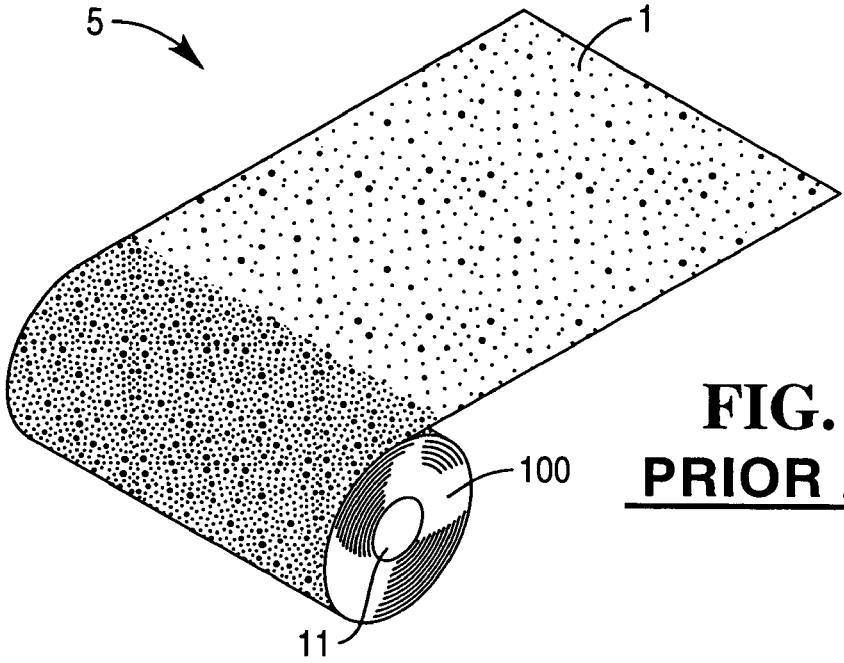
FIG. 1 PRIOR ART
FIG. 1 is a representation of a spent thermal transfer ribbon of the prior art.
Figure 2:
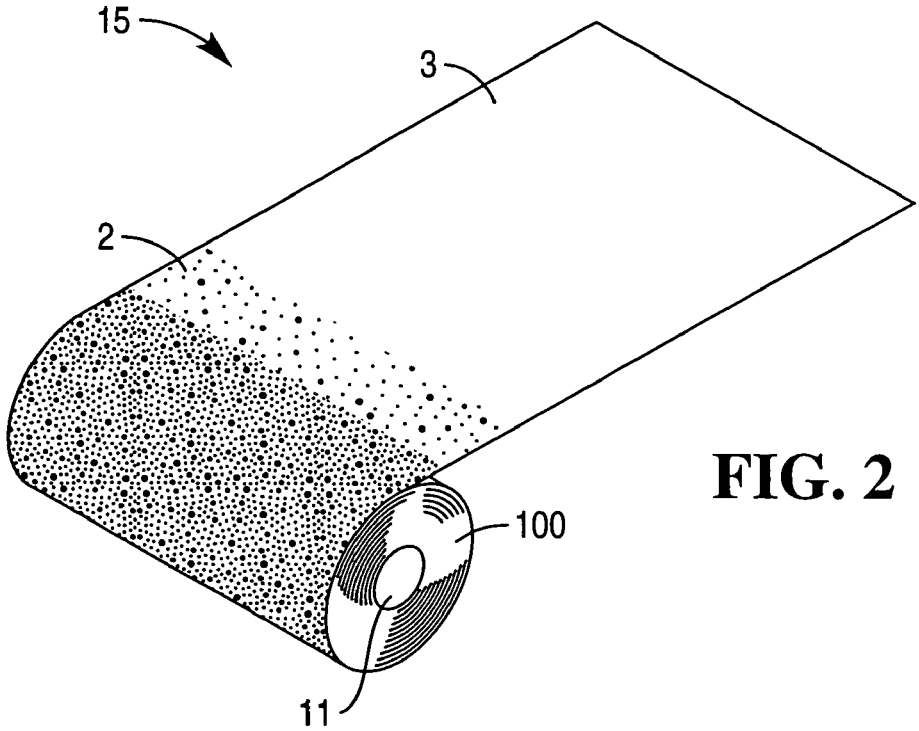
FIG. 2 is a representation of a spent thermal transfer ribbon of the present invention.

The thermal transfer ribbon of the present invention comprises a functional portion which comprises a substrate and a thermal transfer layer. This portion of the thermal transfer ribbon provides print. The substrate comprises a synthetic resin, which is preferably a polyester and more preferably a polyethylene terephthalate (PET) polyester or polyethylene naphthalate polyester. A thermal transfer layer (functional layer) is positioned on this substrate. The thickness of the substrate can vary widely and is preferably from 3 to 50 microns when a polyester polymer. Films of about 4.5 micron thickness are most preferred. The polyester substrate defines the width of the thermal transfer ribbon, which falls within the range of 1 to 10 inches. The polyester substrates have high tensile strength and are easy to handle during preparation and use of the thermal transfer ribbon. The polyester substrates provide these properties at a minimum thickness and low heat resistance to prolong the life of the heating elements within thermal print heads. To minimize print head wear, the polyester substrates preferably have a silicone resin back coating comprised of high molecular weight polydimethylsiloxanes such as those available from General Electric Company and Dow Corning Corporation.

A thermal transfer layer is positioned on this substrate. Any conventional thermal transfer layer is suitable for use in the thermal transfer ribbons of this invention. The thermal transfer layers of the ribbons of this invention preferably comprise a wax, a sensible material, and a thermoplastic resin binder. The thermal transfer layer (functional layer) preferably has a softening point within the range of about 50° C. to 250° C. which enables transfer at normal print head energies which range from about 100° C. to 250° C. and more typically from about 100° C. to 150° C. The coat weight of the thermal transfer layer typically ranges from 1.9 to 4.3 $g/m^2$.

The thermal transfer layers of the thermal transfer ribbons of this invention preferably comprise wax as a main dry component. Suitable waxes provide temperature sensitivity and flexibility. Examples include natural waxes such as carnauba wax, rice bran wax, bees wax, lanolin, candelilla wax, motan wax and ceresine wax; petroleum waxes such as paraffin wax and microcrystalline waxes; synthetic hydrocarbon waxes such as low molecular weight polyethylene and Fisher-Tropsch wax; higher fatty acids such as lauric acid, myristic acid, palmitic acid, stearic acid and behenic acid; higher aliphatic alcohol such as stearyl alcohol and esters such as sucrose fatty acid esters, sorbitane fatty acid esters and amides. The wax-like substances preferably have a melting point less than 200° C. and preferably from 40° C. to 130° C. The amount of wax in the thermal transfer layer is preferably above 25 weight percent and most preferably ranges from 25 to 85 percent by weight, based on the weight of dry ingredients.

Although waxes can be used as the sole binder component, the thermal transfer layers of the thermal transfer ribbons of this invention may also comprise a binder resin. Suitable binder resins are those conventionally used in thermal transfer layers. These binder resins include thermoplastic resins and reactive resins such as epoxy resins.

Suitable thermoplastic binder resins include those described in U.S. Pat. Nos. 5,240,781 and 5,348,348 which have a melting point of less than 300° C., preferably from 100° C. to 225° C. Examples of suitable thermoplastic resins include polyvinyl chloride, polyvinyl acetate, vinyl chloride-vinyl acetate copolymers, polyethylene, polypropylene, polyacetal, ethylene-vinyl acetate copolymers, ethylene alkyl (meth)acrylate copolymers, ethylene-ethyl acetate copolymers, polystyrene, styrene copolymers, polyamide, ethylcellulose, epoxy resin, xylene resin, ketone resin, petroleum resin, terpene resin, polyurethane resin, polyvinyl butyryl, styrene-butadiene rubber, saturated polyesters, styrene-alkyl (meth)acrylate copolymer, ethylene alkyl (meth) acrylate copolymers. Suitable saturated polyesters are further described in U.S. Pat. No. 4,983,446. Thermoplastic resins are preferably used in an amount of from 2 to 35 weight percent based on the total dry ingredients of the thermal transfer layer.

Suitable reactive binder components include epoxy resins and a polymerization initiator (crosslinker). Suitable epoxy resins include those that have at least two oxirane groups such as epoxy novolak resins obtained by reacting epichlorohydrin with phenol/formaldehyde condensates or cresol/formaldehyde condensates. Another preferred epoxy resin is polyglycidyl ether polymers obtained by reaction of epichlorohydrin with a polyhydroxy monomer such as 1,4 butanediol. A specific example of suitable epoxy novolak resin is Epon 164 available from Shell Chemical Company. A specific example of the polyglycidyl ether is available from Ciba-Geigy Corporation under the trade name Araldite® GT 7013. The epoxy resins are preferably employed with a crosslinker which activates upon exposure to the heat from a thermal print head. Preferred crosslinkers include polyamines with at least two primary or secondary amine groups. Examples being Epi-cure P101 and Ancamine 2014FG available from Shell Chemical Company and Air Products, respectively. Accelerators such as triglycidylisocyanurate can be used with the crosslinker to accelerate the reaction. When used, the epoxy resins typically comprise more than 25 weight percent of the thermal transfer layer based on dry components in view of their low viscosity. Waxes are typically not necessary when reactive epoxy resins form the binder. Thermoplastic resins may comprise the only binder component for selected thermal transfer layers where at least a portion of the resins are of low molecular weight.

The thermal transfer layers preferably also contain a sensible material which is capable of being sensed visually, by optical means, by magnetic means, by electroconductive means or by photoelectric means. The sensible material is typically a coloring agent, such as a dye or pigment, or magnetic particles or a security ink which is not visible to the naked human eye. Any coloring agent used in conventional ink ribbons is suitable, including carbon black and a variety of organic and inorganic coloring pigments and dyes, examples of which include phthalocyanine dyes, fluorescent naphthalimide dyes and others such as cadmium, primrose, chrome yellow, ultra marine blue, titanium dioxide, zinc oxide, iron oxide, cobalt oxide, nickel oxide, etc. Examples of sensible materials include those described in U.S. Pat. No. 3,663,278 and U.S. Pat. No. 4,923,749. Reactive dyes such as leuco dyes are also suitable. In the case of magnetic thermal printing, the thermal transfer layer includes a magnetic pigment or particles for use in imaging to enable machine reading of the characters. This provides the advantage of encoding or imaging the substrate with a magnetic signal inducible ink.

The thermal transfer layers may also contain conventional additives such as plasticizers, viscosity modifiers, tackifiers, silicone resins etc.

Suitable thermal transfer layers include those that contain a mixture of waxes such as paraffin wax, carnauba wax and hydrocarbon wax. With mixtures of waxes, a thermoplastic resin binder is typically also employed.

The coating formulations that provide the thermal transfer layers can be made by conventional processes such as by mixing a hydrocarbon wax, paraffin wax, carnauba wax and thermoplastic polymer resin for about 15 minutes at a temperature of about 190° F. in water or organic solvent, after which carbon black and black ink are added and ground in an attritor at about 140° F. to 160° F. for about two hours.

The thermal transfer layers can be applied to the ribbon substrate from a solution, dispersion or emulsion of the components using conventional techniques and equipment such as a Meyer Rod or similar wire round doctor bar set up on a conventional coating machine to provide the coating weights described above. A temperature of about 160° F. is maintained during the entire coating process. After the coating formulation is applied, it is optionally passed through a dryer at an elevated temperature to ensure drying and adherence of the thermal transfer layer to the substrate.

The reflective sensor marker used in this invention is positioned on the end of the thermal transfer ribbon. The reflective sensor marker can be positioned directly on the thermal transfer layer or on the side of the ribbon opposite the thermal transfer layer or the reflective sensor marker they can be positioned on a trailer attached to the functional portion of the ribbon.

The reflective sensor marker comprises a single light reflecting surface of a size that permits a sensor within a thermal transfer printer to detect a predetermined amount of reflected light off the moving marker during printing. The light reflecting surface must have a dimension of at least 0.5 inches and less than 10 inches along the length of the ribbon to permit detection. Lengths of 0.75 inch, 1.0 inch, 2.0 inches, 3.0 inches, and up to 10 inches may also be used. With lengths beyond 5 inches there is little advantage over a reflective trailer. Therefore, the dimension along the length of the ribbon is preferably less than 5 inches and more preferably less than 2 inches. Most preferably, the dimension along the length of the ribbon is from about 1.0 inch to about 2.0 inches.

In preferred embodiments the single light-reflecting surface is also equal in width to the ribbon. Preferably, the light reflecting surface has an area from W to 10W square inches, where "W" is the width of the thermal transfer ribbon in inches.

The reflective sensor marker can comprise a reflective material such as foil adhered to the end of the ribbon or it can be an ink with reflective pigments printed on the ribbon. The use of adhered reflective material is simpler and preferred.

The thermal transfer layers of this invention may employ a trailer. When used, the reflective sensor marker appears on the trailer. These optional trailers may be attached to the polyester substrate with adhesive after the thermal transfer layer is applied and after any silicone resin back coat is applied. The trailers may be transparent or made of paper. Alternatively, it may be desirable to remove a portion of the thermal transfer layer and optionally any silicone resin back coat from the substrate to expose the polyester substrate and provide a trailer. Another alternative is to refrain from depositing a thermal transfer layer and optionally the silicone resin back coat on the end of the substrate. Where the substrate of the functional portion is polyethylene terephthalate, the trailer will typically be transparent.

The transparent trailers, when used, are preferably attached directly to the substrate by conventional means, preferably with the use of pressure sensitive adhesive tape. Transparent trailers preferably comprise the same material as the substrate of the ribbon itself, such as the PET polyesters and polyethylene naphthalate polyester.

Preferably, the trailer is sufficiently transparent to permit the detection of the end of the thermal transfer ribbon by a sensor within a thermal transfer printer which stops the printer once a predetermined amount of light transmitted through the thermal transfer ribbon is detected.

The trailer can vary widely in length but at a minimum it is sufficiently long to simultaneously permit attachment of one end to a spool which holds the thermal transfer ribbon and also permit detection of the reflective sensor marker positioned thereon in a thermal transfer printer. The length can range from 5 to 30 inches, preferably 10–20 inches.

Another embodiment of this invention comprises a thermal transfer ribbon with both a reflective sensor marker and a transparent sensor marker positioned on an end thereof. The reflective sensor marker and transparent sensor marker both permit the detection of the end of the ribbon by a sensor within a thermal transfer printer adapted to work with that particular marker. This allows the thermal transfer ribbon to have dual use in printers with different types of sensors.

The reflective sensor marker for this embodiment is preferably as defined above. These ribbons preferably also employ a transparent trailer as the transparent sensor marker. Perforated paper trailers may be suitable for use in some printers. The transparent trailer can be adhered to the functional portion of the thermal transfer ribbon as described above. Alternatively, a portion of a transparent substrate of the functional portion can form the transparent sensor marker where the thermal transfer layer is not present. The transparent sensor marker can comprise the entire trailer or only a portion thereof.

The transparent sensor marker preferably has a length of at least 0.5 inch and more preferably comprises the entire trailer which preferably ranges in length fro 5 to 30 inches.

The thermal transfer ribbons of the present invention provide all the advantages of thermal printing. When the thermal transfer ribbon is exposed to the heating elements of the thermal print head, the thermal transfer layer softens and transfers from the ribbon to the receiving substrate.

Without further elaboration, it is believed that one skilled in the art can, using the preceding description, utilize the present invention to its fullest extent. The entire disclosure of all applications, patents and publications, cited above and below, are hereby incorporated by reference.

What is claimed:

1. A thermal transfer ribbon comprising a substrate with a thermal transfer layer positioned thereon, a transparent trailer which is attached to an end of said substrate, and a reflective sensor marker positioned on said transparent trailer, wherein the reflective sensor marker permits the detection of the end of said thermal transfer ribbon by a sensor within a thermal transfer printer and wherein said sensor stops the thermal transfer printer from printing once a predetermined amount of light reflected from said thermal transfer ribbon is detected, said reflective sensor marker comprising a single light reflecting surface having a dimension along the length of the thermal transfer ribbon of at least 0.5 inch and less than ten inches.

2. A thermal transfer ribbon as in claim 1 wherein the single light reflecting surface is equal in width to the ribbon width and has a dimension along the length of the thermal transfer ribbon of less than 5 inches.

3. A thermal transfer ribbon as in claim 1 wherein the single light-reflecting surface has an area from W to 10W square inches, wherein W is the width of said thermal transfer ribbon in inches.

4. A thermal transfer ribbon as in claim 1 wherein the reflective sensor marker is equal in width to the thermal transfer ribbon and has a dimension along the length of the ribbon of about 1 inch to about 2 inches, and the surface area of the reflective sensor marker is from about W to 2W square inches wherein W is the width of said thermal transfer ribbon in inches.

5. A thermal transfer ribbon as in claim 1 wherein the trailer is either adhered to the substrate of the thermal transfer ribbon or is a continuation of a transparent substrate of the functional portion of the thermal transfer ribbon without a thermal transfer layer positioned thereon.

6. A thermal transfer ribbon as in claim 5 wherein the reflective sensor marker comprises a reflective material taped to the trailer.

7. A thermal transfer ribbon as in claim 6 wherein the reflective sensor marker provides a single reflective surface equal in width to the thermal transfer ribbon width and has a dimension along the length of the thermal transfer ribbon of at least 0.75 inch.

8. A thermal transfer ribbon as in claim 7 wherein the single light-reflecting surface has an area from W square inches to 10W square inches, wherein W is the width of the thermal transfer ribbon in inches.

9. A thermal transfer ribbon as in claim 5 wherein the trailer is sufficiently transparent to provide a transparent sensor marker that permits the detection of the end of said thermal transfer ribbon by a sensor within a thermal transfer printer, wherein said sensor stops the thermal transfer printer from printing once a predetermined amount of light transmitted through the thermal transfer ribbon is detected, said trailer having a width equal to that of said thermal transfer ribbon and a length of at least 5 to 30 inches.

10. A thermal transfer ribbon comprising a functional portion which comprises a substrate and a thermal transfer layer positioned thereon and both a reflective sensor marker and a transparent sensor marker, each positioned on the same end of said thermal transfer ribbon, wherein said reflective sensor marker permits the detection of the end of said thermal transfer ribbon by a sensor within a thermal transfer printer which stops the thermal transfer printer from printing once a predetermined amount of light reflected from the thermal transfer ribbon is detected, and wherein said transparent sensor marker permits the detection of the end of said thermal transfer ribbon by a sensor within a thermal transfer printer which stops the thermal transfer printer from printing once a predetermined amount of light transmitted through said thermal transfer ribbon is detected.

11. A thermal transfer ribbon as in claim 10 wherein the transparent sensor marker is a transparent trailer attached to the functional portion of said thermal transfer ribbon, and wherein the reflective sensor marker is positioned on said transparent trailer.

12. A thermal transfer ribbon as in claim 11 wherein the transparent trailer is either adhered to the substrate of the thermal transfer ribbon or is a continuation of a substrate of the functional portion of the thermal transfer ribbon without a thermal transfer layer positioned thereon.

13. A thermal transfer ribbon as in claim 12 wherein the reflective sensor marker comprises a reflective material taped to the trailer and the transparent trailer is of a length from 5–20 inches.

14. A thermal transfer ribbon as in claim 13 wherein the reflective sensor marker provides a single light reflecting surface equal in width to the width of the thermal transfer ribbon and has a dimension along the length of the thermal transfer ribbon of at least 0.5 inch and less than ten inches.

15. A thermal transfer ribbon as in claim 14 wherein said single light reflective surface has an area from 1W to 10W, wherein W is the width of the thermal transfer ribbon in inches.

* * * * *